US005573710A

United States Patent [19]

McDonell

[11] Patent Number: 5,573,710

[45] Date of Patent: Nov. 12, 1996

[54] MULTISURFACE CLEANING COMPOSITION AND METHOD OF USE

[75] Inventor: James A. McDonell, Woodbury, Minn.

[73] Assignee: Minnesota Mining and Manufacturing Company, St. Paul, Minn.

[21] Appl. No.: 587,246

[22] Filed: Jan. 16, 1996

Related U.S. Application Data

[63] Continuation of Ser. No. 327,481, Oct. 21, 1994, abandoned, which is a continuation of Ser. No. 39,632, Mar. 30, 1993, abandoned.

[51] Int. Cl.[6] ..... C11D 1/75; C11D 1/62; C11D 3/43; C11D 3/44

[52] U.S. Cl. ..... 510/405; 510/356; 510/363; 510/365; 510/433

[58] Field of Search ..... 252/547, 153, 252/DIG. 10

[56] References Cited

U.S. PATENT DOCUMENTS

| | | | |
|---|---|---|---|
| 2,710,843 | 6/1955 | Stebleton | 252/158 |
| 2,901,433 | 8/1959 | Spring | 252/118 |
| 2,929,789 | 3/1960 | Pickett et al. | 252/153 |
| 2,958,593 | 11/1960 | Hoover et al. | 51/295 |
| 3,202,714 | 8/1965 | Zimmerer et al. | 260/584 |
| 3,367,878 | 2/1968 | Mankowich | 252/110 |
| 3,463,735 | 8/1969 | Stonebraker et al. | 252/137 |
| 3,553,144 | 1/1971 | Murphy | 252/158 |
| 3,615,827 | 10/1971 | Murphy | 134/38 |
| 3,634,338 | 1/1972 | Laugle et al. | 252/525 |
| 3,664,962 | 5/1972 | Kelly et al. | 252/125 |
| 3,696,043 | 10/1972 | Labarge et al. | 252/153 |
| 3,806,460 | 4/1974 | Mukai et al. | 252/111 |
| 3,872,021 | 3/1975 | McKnight | 252/121 |
| 3,882,038 | 5/1975 | Clayton et al. | 252/162 |
| 3,917,850 | 11/1975 | Boucher | 424/333 |
| 3,939,090 | 2/1976 | Zmoda | 252/90 |
| 3,948,819 | 4/1976 | Wilde | 252/545 |
| 4,013,607 | 3/1977 | Dwyer et al. | 260/29.6 H |
| 4,017,409 | 4/1977 | Demessemaekers et al. | 252/109 |
| 4,040,977 | 8/1977 | Eggensperger et al. | 252/401 |
| 4,144,201 | 3/1979 | Winterbotham et al. | 252/547 |
| 4,174,304 | 11/1979 | Flanagan | 252/542 |
| 4,175,062 | 11/1979 | Disch et al. | 252/540 |

(List continued on next page.)

FOREIGN PATENT DOCUMENTS

| | | | |
|---|---|---|---|
| 0130786A3 | 1/1985 | European Pat. Off. | C11D 7/08 |
| 0518401A1 | 5/1992 | European Pat. Off. . | |
| 2571279 | 4/1986 | France . | |
| A2582546 | 12/1986 | France . | |
| 57-77111 | 6/1977 | Japan . | |
| 54-14406 | 2/1979 | Japan . | |
| 56-22397 | 3/1981 | Japan . | |
| 57-28199 | 2/1982 | Japan . | |
| 57-83598 | 5/1982 | Japan . | |
| 58-185700 | 10/1983 | Japan . | |
| 59-70652 | 4/1984 | Japan . | |
| 1240469 | 7/1971 | United Kingdom . | |
| 1602234 | 11/1981 | United Kingdom . | |
| 2166153 | 4/1986 | United Kingdom . | |
| WO91/00337 | 1/1991 | WIPO . | |
| WO91/00336 | 10/1991 | WIPO . | |

OTHER PUBLICATIONS

ARCO Chemical Company trade literature "Introducing Arcosolv PTB Solvent" Sep. 1992.

Kuraray Co., LTD, Product Brochure "3–Methyl–3–Methoxy Butanol" Feb. 1992.

Ibert Mellan, "Industrial Solvents Handbook", pp. 346–349; 565 Jun. 1977.

Chemical Abstracts, vol. 94 (1981) Jun., No. 26, Columbus, Ohio, p. 110.

Patent Abstract of Japanese Publication No. JP4076099, Mar. 10, 1992.

"Amine Oxides & Their Applications", Rorig and Stephan, La Rivista Italiana Delle Sostanze Grasse, vol. LXVII, Guigno 1991.

"Cationic Surfactants in Cleaner Formulations", Stephan, Tenside Surf, Det 29 (1992)3.

(List continued on next page.)

*Primary Examiner*—Paul Lieberman
*Assistant Examiner*—Erin M. Harriman
*Attorney, Agent, or Firm*—Gary L. Griswold; Walter N. Kirn; Daniel R. Pastirik

[57] ABSTRACT

Multi-surface cleaning compositions and methods of use are presented. Compositions within the invention which are substantially non-streaking on hard surfaces comprise:

a) a surfactant selected from the group consisting of amine oxides within the general formula (I)

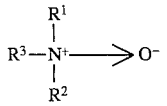

I and quaternary amine salts within the general formula (II)

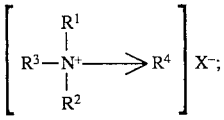

II b) a very slightly water-soluble polar organic compound; and c) an effective amount of a water soluble organic compound selected from water soluble glycol ethers and water soluble alkyl alcohols.

wherein $R^1$ and $R^2$ are the same or different and are selected from the group consisting of alkyl and substituted alkyl groups, $R^3$ is selected from the group consisting of straight chain alkyls, branched chain alkyls, straight chain heteroalkyls, and branched chain heteroalkyls having from about 10 to 20 carbon atoms, $R^4$ is selected from the group consisting of alkyl groups having from 1 to about 5 carbon atoms (preferably methyl), and X is a halogen atom, preferably atomic chlorine.

28 Claims, No Drawings

U.S. PATENT DOCUMENTS

| | | | |
|---|---|---|---|
| 4,203,872 | 5/1980 | Flanagan | 252/542 |
| 4,225,471 | 9/1980 | Claus et al. | 252/547 |
| 4,235,734 | 11/1980 | Scherubel | 252/142 |
| 4,240,919 | 12/1980 | Chapman | 252/95 |
| 4,254,104 | 3/1981 | Suzuki | 424/170 |
| 4,264,466 | 4/1981 | Carleton et al. | 252/99 |
| 4,264,729 | 4/1981 | Beljanski | 435/6 |
| 4,297,251 | 10/1981 | Bernardino | 252/545 |
| 4,348,292 | 9/1982 | Ginn | 252/90 |
| 4,414,128 | 11/1983 | Goffinet | 252/111 |
| 4,460,374 | 7/1984 | Abel et al. | 8/501 |
| 4,472,291 | 9/1984 | Rosano | 252/186.28 |
| 4,501,680 | 2/1985 | Aszman et al. | 252/142 |
| 4,552,685 | 11/1985 | Kernstock et al. | 252/355 |
| 4,561,991 | 12/1985 | Herbots et al. | 252/118 |
| 4,576,728 | 3/1986 | Stoddart | 252/102 |
| 4,606,842 | 8/1986 | Keyes et al. | 252/174.23 |
| 4,606,850 | 8/1986 | Malik | 252/528 |
| 4,615,819 | 10/1986 | Leng et al. | 252/110 |
| 4,673,523 | 6/1987 | Smith et al. | 252/91 |
| 4,726,915 | 2/1988 | Verdicchio | 252/542 |
| 4,741,863 | 5/1988 | Yamamoto et al. | 252/547 |
| 4,749,509 | 6/1988 | Kacher | 252/139 |
| 4,758,377 | 7/1988 | Iding et al. | 252/556 |
| 4,767,563 | 8/1988 | Buzzaccarini | 252/174.25 |
| 4,769,172 | 9/1988 | Siklosi | 252/153 |
| 4,790,951 | 12/1988 | Wittpenn, Jr. et al. | 252/547 |
| 4,814,109 | 3/1989 | Frieser et al. | 252/162 |
| 4,863,629 | 9/1989 | Osberghaus et al. | 252/162 |
| 4,891,147 | 1/1990 | Gray et al. | 252/104 |
| 4,900,467 | 2/1990 | Smith | 252/95 |
| 4,909,962 | 3/1990 | Clark | 252/547 |
| 4,927,556 | 5/1990 | Pokoray | 252/173 |
| 4,931,726 | 6/1990 | Kasukabe et al. | 324/158 F |
| 4,975,218 | 12/1990 | Rosser | 252/117 |
| 5,019,289 | 5/1991 | Gray et al. | 252/95 |
| 5,021,195 | 6/1991 | Machin et al. | 252/545 |
| 5,035,826 | 7/1991 | Durbut et al. | 252/121 |
| 5,041,239 | 8/1991 | Rorig et al. | 252/315.1 |
| 5,080,822 | 1/1992 | Van Eenam | 252/170 |
| 5,080,831 | 1/1992 | Van Eenam | 252/558 |
| 5,093,031 | 3/1992 | Login et al. | 252/357 |
| 5,126,068 | 6/1992 | Burke et al. | 252/174.21 |
| 5,158,710 | 10/1992 | Van Eenam | 252/539 |
| 5,252,245 | 10/1993 | Garabedian, Jr. et al. | 252/153 |
| 5,419,848 | 5/1995 | Van Eenam | 252/164 |

OTHER PUBLICATIONS

"Cationic Surfactants As Thickening Agents In Hard Surface Cleaners", AOCS Presentation in Toronto 1992 (Paper Presumably Published or to be Published in JAOCS Later).

"Ethers for Household and Institutional Products", published 1976) no month available.

International Specialty Products product literature "Surfadone LP Specialty Solvents and Surfactants", 1992 no month available.

"Solvent Formulations From Eastman Chemicals", Sep. 1983.

Exxon Chemical Company product literature "AO–14–2", Dec. 4, 1991.

Exxon Chemical Company product literature "Non–Butyl Cleaners", Dec. 1980.

Exxon Chemical Company, "1992 Formulary" Mar. 8, 1989.

"Household and Personal Products Industry," May 1982, pp. 48–54.

MULTISURFACE CLEANING COMPOSITION AND METHOD OF USE

This is a continuation of application No. 08/327,481 filed Oct. 21, 1994, now abandoned, which is a continuation of application No. 08/039,631, filed Mar. 30, 1993, now abandoned.

BACKGROUND OF THE INVENTION

1. Brief Description of the Invention

The present invention relates to a cleaning composition specifically formulated to clean hard surfaces without streaking, but which may have other uses such as removal of grease, stains, and the like from fibrous substrates such as carpet and upholstery.

2. Related Art

The goal of formulating a cleaning composition which will effectively remove greasy residues while not leaving significant streaks on a hard surface being cleaned has led to a bewildering array of cleaning compositions on the market. In general, the user wishes to achieve the fastest cleaning, with the least streaking on hard surfaces, with the least amount of composition. Also desired is a composition which does not have adverse effects on the user or the environment, and which preferably can be used on surfaces other than hard surfaces, such as carpet, furniture, and the like.

One hard surface cleaning composition disclosed in the patent literature (U.S. Pat. No. 4,863,629) comprises an effective amount of propylene glycol mono-t-butyl ether as the primary cleaning and non-streaking ingredient. Propylene glycol mono-t-butyl ether is available from Arco Chemical Company under the trade designation "Arcosolv PTB." Trade literature published for "Arcosolv PTB" announced that propylene glycol mono-t-butyl ether may be combined with other glycol ethers to render the latter more soluble in water.

Although compositions containing propylene glycol mono-t-butyl ether as disclosed in the above-referred patent are apparently quite effective in being non-streaking on hard surfaces, the compositions according to this patent may not be as effective on grease as some users desire. Users are always desirous of better grease removal properties in cleaning compositions, especially those which are non-streaking on glass and other hard surfaces, and which can be used effectively to clean other surfaces, such as carpet.

SUMMARY OF THE INVENTION

In accordance with the present invention, compositions are described which are useful in removing grease, heel marks, and the like from hard surfaces without streaking. Further, the compositions may have other uses such as removing food soils, grease, and the like from fibrous substrates such as carpet, furniture, and similar substrates.

The inventor herein has discovered that specific compounds having surfactant function, particularly amine oxides and quaternary amine salts, when combined with a very slightly water-soluble polar organic compound, have a surprising synergistic effect in removal of grease. These compositions within the invention are termed "multi-surface cleaning compositions."

In addition when a third ingredient, comprising an effective amount of a water soluble glycol ether or alcohol, is added, the compositions are substantially non-streaking on hard surfaces. Further, the compositions are useful in removing food residues from carpet and upholstery, and are thus termed "non-streaking multi-surface" cleaning compositions.

Thus, one aspect of the invention is a composition useful as an aqueous multi-surface cleaner comprising:

a) a surfactant selected from the group consisting of amine oxides within the general formula (I)

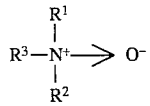

I and quaternary amine salts within the general formula (II)

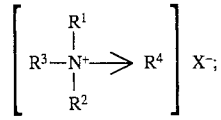

II b) a very slightly water-soluble polar organic compound; and c) an effective amount of a water soluble organic compound selected from glycol ethers and alkyl alcohols, wherein $R^1$ and $R^2$ are the same or different and are selected from the group consisting of alkyl and substituted alkyl groups, $R^3$ is selected from the group consisting of straight chain alkyls, branched chain alkyls, straight chain heteroalkyls, and branched chain heteroalkyls having from about 10 to 20 carbon atoms, $R^4$ is selected from the group consisting of alkyl groups having from 1 to about 5 carbon atoms (preferably methyl), and X is a halogen atom, preferably atomic chlorine.

A "multi-surface cleaning composition" within the invention is not non-streaking, and thus does not contain component (c).

As used herein the term "very slightly water-soluble" means that polar organic compounds useful in the invention are soluble in water at concentrations ranging from about 0.01 to about 1.0 weight percent at 20° C. The term "water soluble" means that the organic compound (glycol ether or alkyl alcohol) has a water solubility of at least 1.0 weight percent in water at 20° C. "Effective amount" means that amount necessary to formulate a composition which is non-streaking on hard surfaces, where "non-streaking" means there is no residue apparent to the human eye under a standard light source. "Hard surface" is meant to include surfaces such as glass window panes, ceramic tiles, marble, terrazzo, and the like. The term "fibrous substrate" is meant to include relatively porous materials such as carpet, upholstery, clothing, and the like, and is meant to exclude hard surfaces such as glass, ceramic tile, and the like.

It has also been discovered that if branched chain "ether" amine oxide surfactants are used in combination with a very slightly water-soluble polar organic compound and a water soluble glycol ether, the characteristics of excellent grease removal and non-streaking are present, and the composition is low-foaming. "Low-foaming" as used herein means that compositions of the invention employing branched chain ether amine oxides as the surfactant produce less foam than the same composition using a straight chain ether amine oxide surfactant. This is especially advantageous when the compositions of the invention are employed as glass cleaners. Of course, in some instances it may be desired to employ the straight chain ether amine oxides when foaming of the composition is desired. The quaternary amine salts useful in the invention as surfactants also preferably reduce the tendency of the compositions of the invention to be low-foaming; however, they may in some embodiments cause undesirable streaking on glass.

Examples of very slightly water-soluble polar organic compounds useful in the compositions of the invention for their synergistic cleaning effect with the above surfactants include: glycol ethers having from about 8 to about 15 carbon atoms, such as ethylene glycol 2-ethylhexyl ether and ethylene glycol mono-n-hexyl ether; alcohols having from 4 to about 10 carbon atoms, such as isooctyl alcohol, 1-octanol, and 2-ethyl hexanol; and N-alkyl pyrrolidones where the alkyl group has from about 6 to about 10 carbon atoms, such as N-octyl pyrrolidone.

Preferred water soluble glycol ethers useful for their ability to make the compositions of the invention non-streaking on hard surfaces include propylene glycol mono-t-butyl ether (water solubility of about 16 weight percent) and propylene glycol mono-methyl ether, which is infinitely soluble in water, and which may be preferred by users desiring a more palatable odor.

Preferred water soluble alkyl alcohols useful for their ability to make the compositions of the invention non-streaking on hard surfaces include propanol, isopropanol, butanol, isobutanol and the like, with isopropanol being particularly preferred.

Various optional (active and/or inactive) ingredients may be included in concentrated and "ready-to-use" versions of the above inventive compositions. As used herein the term "active" means the ingredient alone or in combination has an effect on the cleaning and/or non-streaking ability of the composition. In contrast, "inactive" means the component is added primarily for aesthetic purposes, such as odor, color, and the like. The compositions may include inactive ingredients such as water, fragrances, and dyes, and actives such as pH adjustment ingredients (for example low molecular weight hydroxy-functional amines), surfactants other than those within general formulas I and II, chelating agents, and the like.

Two further aspects of the invention are methods of cleaning soiled hard surfaces and fibrous substrates comprising applying to the soiled surface an effective amount of one of the compositions within the present invention, and removing the soil from the hard surface or fibrous substrate, as the case might be. As used herein the term "soiled hard surface" means a hard surface that has a residue such as food grease, petroleum grease, heel marks and the like thereon. When substances such as pencil, pen, permanent marker and china marker lines or marks are to be removed, the method preferably further comprises scrubbing the soiled hard surface with an abrasive article, preferably a nonwoven abrasive such as that described and claimed in U.S. Pat. No. 2,958,593 (Hoover et. al.).

In the methods of the invention pertaining to removing soils from fibrous substrates, the composition is applied to the soiled area, the soil and composition allowed to contact the soiled area for a time sufficient to at least partially dissolve the soil, and the residue/composition mixture removed from the fibrous substrate, preferably with a wet vacuum.

Further aspects and advantages of the invention will become apparent by reviewing the description of preferred embodiments and examples which follow.

DESCRIPTION OF PREFERRED EMBODIMENTS

As previously mentioned, a "multi-surface" cleaner within the invention is one that will be non-streaking when used to clean hard surfaces such as glass surfaces, ceramic surfaces, and the like, and will also be effective at removal of grease, food soil, and the like, from a variety of fibrous substrates. When previously known compositions were formulated to be non-streaking for glass, the compositions tended to decrease in effectiveness in grease removal as some users demand. Conversely, when cleaning compositions were formulated to remove grease effectively and when the compositions were also used to clean glass, the compositions tended to streak at a level which was unacceptable to many users.

The multi-surface cleaning compositions of the present invention have been carefully formulated to be both effective in removing grease from hard surfaces, to be substantially non-streaking, and to be an effective cleaner of soiled carpets and other fibrous substrates. The individual components of the cleaning compositions of the invention will now be described in greater detail.

Surfactants

Amine Oxide Surfactants

Amine oxides useful as surfactants in the cleaning compositions of the invention which have been found to have a synergistic cleaning effect with slightly water-soluble polar organic compounds are within general formula I:

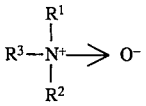

I wherein $R^1$ and $R^2$ are selected from alkyl and substituted alkyl groups such as methyl, ethyl, propyl, isopropyl, hydroxyethyl, hydroxypropyl, and the like. $R^1$ and $R^2$ of course may be the same or different. $R^3$ is typically and preferably a straight or branched alkyl or heteroalkyl moiety having from about 10 to 20 carbon atoms, and may include alkyl ethers having from about 10 to 20 carbon atoms ("ether" amine oxides).

Particularly preferred amine oxides useful in the present invention within general formula I are ether amine oxides having branched $R^3$ heteroalkyl groups, such as that known in the trade designation "A0-14-2", available from EXXON Chemical Company, Houston, Tex., in which $R^1$ and $R^2$ are each hydroxyethyl, while $R^3$ is isodecyloxypropyl. The branched ether amine oxides are lower foaming, and may be preferred in certain formulations. Another useful amine oxide within the above general formula is that wherein $R^1$ and $R^2$ are each methyl, and $R^3$ is $C_{12}$ alkyl, such as lauryl amine oxide.

Quaternary Amine Salt Surfactants

Quaternary amine salts are based on the reaction of high molecular weight aliphatic tertiary amines with an alkylating agent such as methyl chloride. They are generally more cationic and more stable to pH change than other amine-based surfactants such as ethoxylated amines. Quaternary amine salts useful as surfactants in the cleaning compositions of the invention which have a synergistic cleaning effect with slightly water-soluble polar organic compounds are those within general formula II:

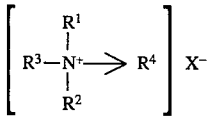

II wherein $R^1$, $R^2$, and $R^3$ are as above defined in reference to the amine oxides, $R^4$ is selected from the group consisting of alkyl groups having from 1 to about 5 carbon atoms (preferably methyl), and X is a halogen atom, preferably atomic chlorine. Those quaternary amine salts which are readily combinable with the other ingredients of the compositions of the invention to form one phase compositions are preferred.

Particularly preferred quaternary amine salts useful in the present invention within general formula II are those in which $R^1$ and $R^2$ are each hydroxyethyl, and $R^3$ is isotridecyloxypropyl. One such quaternary amine salt is that known under the trade designation "Q-17-2" from EXXON Chemical Company, Houston, Tex. wherein $R^1$ and $R^2$ are each hydroxyethyl, and $R^3$ is isotridecyloxypropyl, $R^4$ is methyl, and X is atomic chlorine.

It should be appreciated that a combination of surfactants within general formulas I and II could be employed in the compositions of the invention, provided the selected surfactants within general formulas I and II are compatible with each other and the other ingredients, or capable of being rendered compatible therewith.

As the amount of surfactant within general formulas I and/or II is decreased, the grease removal property of the compositions of the invention may decrease; however, the amount of very slightly water-soluble polar organic compound may be increased to compensate, assuming a surfactant other than one within general formulas I and/or II, or a coupler is added to keep the added polar organic compound solubilized.

Very Slightly Water-Soluble Polar Organic Compounds

Any one of a number of polar organic compounds may be used in the compositions of the invention for their ability to remove grease, food soils, and the like from hard surfaces and fibrous substrates, provided they have a water solubility less than about 1.0 weight percent, more preferably less than about 0.5 weight percent, but in all cases more than 0.01 weight percent (all water solubilities referred to herein are at 20° C.). A mixture of very slightly water-soluble polar organic compounds may also be used, provided they are sufficiently compatible with each other and with the other ingredients.

One class of preferred polar organic compounds within the defined water solubility range are ethylene glycol ethers having from about 6 to about 12 carbon atoms. Examples of glycol ethers meeting this description include ethylene glycol 2-ethylhexyl ether (0.2 weight percent soluble in water), and ethylene glycol hexyl ether (1.0 weight percent soluble in water). Ethylene glycol 2-ethylhexyl ether is available under the trade designation "Ektasolve EEH" from Eastman Chemical Products, Inc., Kingsport, Ten. Ethylene glycol hexyl ether is available under the trade designation hexyl "Cellosolve" from Union Carbide Corporation.

Although the trend in the industry has been toward use of propylene glycol ethers (see for example Morris, "Propylene-based Glycol Ethers", *Household and Personal Products Industry*, May, 1982, pages 48–54), in the examples which follow, it is evident that not all glycol ethers perform the same in removing grease when combined with an amine oxide surfactant. One example of a glycol ether which is not effective in the compositions of the invention is propylene glycol n-butyl ether (available under the trade designation "Dowanol PnB" from Dow Chemical Corporation, and "Propasol Solvent B" from Union Carbide Corporation). Propylene glycol n-butyl ether has a water solubility of about 5.6 weight percent, and was largely ineffective in removing grease when combined with an amine oxide surfactant. The glycol ether known under the trade designation butyl "Dipropasol", also from Union Carbide Corporation, having water solubility of about 3.0 weight percent, was slightly more effective in removing a standard food grease than propylene glycol n-butyl ether, but is not a preferred glycol ether. In preferred compositions of the invention comprising a glycol ether as the very slightly water-soluble polar organic compound and an amine oxide surfactant, it has been discovered that as the water solubility of glycol ethers decreases, the grease removal performance of the compositions increases.

Another class of useful very slightly water-soluble polar organic compounds useful in the present invention include normal and branched chain alkyl alcohols having from about 6 to about 12 carbon atoms, such as isooctyl alcohol (water solubility of 0.06 weight percent), 1-octanol, and 2-ethyl hexanol (each having a water solubility of about 0.1 weight percent). Isooctyl alcohol is available under the trade designation "Exxal 8" from Exxon Chemical Company, Houston, Tex. According to Exxon Chemical Company trade literature, "Exxal 8" is a mixture of isomers, the major isomers being dimethyl-1hexanol and methyl-1-heptanol.

Yet another class of very slightly water soluble polar organic compounds useful in the present invention are N-alkyl pyrrolidones having water solubility within the preferred ranges previously mentioned. One useful example is N-octyl pyrrolidone (solubility of 0.124 weight percent in water), available under the trade designation "Surfadone LP-100" from International Specialty Products, Wayne, N.J. It should be noted that although the N-alkyl pyrrolidones are themselves very slightly water-soluble, the addition of a small quantity of an anionic or a non-ionic surfactant may increase their solubility and wetting speed.

The N-alkyl pyrrolidones may serve as complexing agents for materials that form hydrogen bonds such as pigments, dyes, phenols, carboxylic acids and the like. N-alkyl pyrrolidones do not reach a critical micelle concentration in water; however, when mixed with surfactants they readily form mixed micelles which increase their solubility. N-alkyl pyrrolidones are also low foaming in aqueous solutions. If foaming of the compositions of the invention is a problem when using N-alkyl pyrrolidones as the very slightly water-soluble polar organic compound, it may be desirous to add a non-foaming additive such as those known under the trade designations "SAG 2001" (Union Carbide), "Tergitol MDS-42" (Union Carbide), or "Defoamer S" (Heart Products, Inc.).

Use of a mixture of any of the very slightly water-soluble polar organic compounds mentioned herein may be used, provided they are compatible with each other and with the other ingredients.

In compositions in accordance with the invention, the weight ratio of active very slightly water-soluble polar organic compound to active surfactant typically and preferably ranges from about 0.1:1 to about 1:1, more preferably ranging from about 0.2:1 to about 0.4:1.

Streak-Reducing Water Soluble Glycol Ethers and Alcohols

The multi-surface cleaning compositions of the present invention may also include an effective amount of a water soluble organic compound to reduce streaking when used to clean hard surfaces. As previously mentioned, compositions within the invention having this ingredient are referred to as non-streaking multi-surface cleaners.

Water-soluble glycol ethers useful in the invention may be selected from the group consisting of glycol ethers and alkyl alcohols, or combination thereof, which serves the primary function of reducing the streaking, or residue, left when the compositions are used to clean glass windows, ceramic tiles and the like. Further, the water soluble organic compound serves to increase the volatility of the compositions to achieve faster drying, which is an important aspect demanded by users of glass cleaners.

Examples of water soluble glycol ethers useful in the invention are many and include, the following water miscible glycol ethers: ethylene glycol methyl ether, ethylene glycol ethyl ether, ethylene glycol mono-n-butyl ether, diethylene glycol methyl ether, diethylene glycol ethyl ether, methoxy triglycol, ethoxy triglycol, butoxy triglycol, 1-butoxyethoxy-2-propanol, propylene glycol n-propyl ether, propylene glycol methyl ether, dipropylene glycol methyl ether, and 3-methyl-3-methoxybutanol. Another useful glycol ether is propylene glycol mono-t-butyl ether, (water solubility of 14.5 weight percent at 20 degrees C.). Combinations of the above water soluble glycol ethers may also be employed. A particularly preferred glycol ether which exhibits non-streaking properties when used in the compositions of the present invention is propylene glycol monomethyl ether, available under the trade designations "Dowanol" PM (from Dow Chemical Company, Midland, Mich.), "Propasol Solvent M" (from Union Carbide Corporation, Danbury, Conn.), and "Arcosolv" PM (from Arco Chemical Company, Philadelphia, Pa.).

Preferred water soluble alkyl alcohols were previously mentioned. One preferred water soluble alkyl alcohol is isopropanol, which has an evaporation rate of about 230 (referenced to n-butyl acetate, which is often given the standard evaporation rate value of 100).

In compositions in accordance with the invention which include an ether amine oxide surfactant, glycol ethers having infinite water solubility are the preferred water soluble organic compound.

The weight ratio of active surfactant within general formulas I and/or II to active non-streaking water soluble organic compound preferably ranges from about 0.033:1 to about 0.2:1, more preferably ranging from about 0.07:1 to about 0.13:1.

The weight ratio of very slightly water-soluble polar organic compound to streak-reducing water-soluble organic compound in non-streaking multi-surface cleaning compositions of the invention preferably ranges from about 0.0033:1.0 to about 0.2:1.0, more preferably ranging from about 0,007:1.0 to about 0.13:1.0.

If the non-streaking water soluble organic compound is present in the concentrated compositions at a concentration less than about 60 weight percent, when the concentrate is diluted to ready-to-use volume with water, the ready-to-use composition may not exhibit the non-streaking property which defines a "non-streaking multi-surface" cleaner within the invention. If the amount of non-streaking glycol ether component in the concentrate is greater than about 60 weight percent, this would tend to dilute the amine oxide surfactant and very slightly water-soluble solvent components, thereby decreasing the overall cleaning ability of the composition.

Optional Ingredients

The compositions of the present invention may include various optional additives such as a colorant to provide a more aesthetic appearance, a fragrance to provide more acceptable smell, a preservative to prevent microbial growth in the solution, a suitable agent to eradicate germs, mold or mildew, antioxidants, surfactants other than those within general formulas I and II, chelating agents which may be required with certain other surfactants, pH adjustment chemicals, and the like. Such components are well known in the art and specific amounts of each will be within the knowledge of the skilled artisan.

The compositions of the present invention preferably have pH (i.e., negative logarithm of the hydrogen ion concentration) which renders the compositions basic, i.e., pH greater than 7.0, which renders the compositions more efficient in solubilizing grease. One preferred class of pH adjustment chemicals are the low molecular weight alkanol amine compounds such as monoethanolamine and the like, which are typically added to the concentrated solutions of the invention at concentrations ranging from about 10 to about 20 weight percent based on total weight of concentrate. When an alkanol amine is used, it is typically beneficial to add a surfactant such as dodecylbenzene sulfonic acid, which is neutralized by the alkanol amine additive. In this regard it is desired to avoid sodium salts of dodecylbenzene sulfonic acid and other acid surfactants, as use of the salt form of dodecylbenzene sulfonic acid tends to precipitate out in low water-containing concentrates. Acid forms of surfactants such as dodecylbenzene sulfonic acid may be used in the concentrates of the invention at about 0.5 to about 3.0 weight percent, more preferably ranging from about 1.0 to about 2.0 weight percent of the concentrate. One source of dodecylbenzene sulfonic acid is that known under the trade designation "Witcolate 1298", from Witco Chemical Company.

If deionized water is not to be used as the dilution medium, it is frequently desired to add a chelating agent to the concentrate, such as 1-hydroxyethylidene-1,1-diphosphonic acid. This chelating agent is available under the trade designation "Dequest" 2010, from Monsanto Corporation, St. Louis, Mo. This component is typically added to the concentrate at a weight percent ranging from about 0.1 to about 0.3 weight percent.

Suitable antioxidants include butylated hydroxytoluene ("BHT"), available from Exxon Chemical Company, Houston, Tex. Antioxidants prevent or reduce the formation of peroxides, which may catalyze the degradation of the dye or other ingredients.

Ammonium thiosulfate ("ATS") may be added to neutralize any peroxide which may be in surfactants within general formulas I and II, which may cause fading of various dyes which may be used in the compositions of the invention.

The compositions of the invention can, of course, be made, sold, and used as concentrates, or in diluted form. When in diluted or "ready-to-use" form, the compositions preferably have the same ratios of actives as the concentrates. Actual effective dilution of the concentrates will depend on the intended surface to be cleaned, type of soil, degree of soiling, and the like. Table 1 lists various preferred properties of concentrated and ready-to-use compositions within the invention.

TABLE 1

| Property | Concentrate Properties | Ready-to-Use[2] Properties |
|---|---|---|
| Specific gravity (20° C.) | 0.97–0.99 g/cc | 1.00 |
| pH | 11.5–12.5 | 11.5–12.5 |
| Flashpoint (TCC)[1] | 40–45° C. | 45–65° C. |
| Viscosity[3] | 7–10 centipoise | 2.0–4.0 centipoise |
| VSWSPOC:S[4] | 0.3:1 | 0.3:1 |
| S:WSOC[5] | 0.1:1 | 0.1:1 |

[1]TCC means Tag Closed Cup
[2]Ready-to-use compositions are concentrate solutions diluted with water from about 9:1 to about 15:1, more preferably about 12:1
[3]Measured using Brookfield viscometer Model LVTD, # 1 spindle, at 60 rpm, at 20° C.
[4]Weight ratio, very slightly water-soluble polar organic compound to surfactant within general formulas I and II
[5]Weight ratio, surfactant within general formulas I and II to water soluble organic compound

Methods of Use of the Inventive Compositions

The compositions of the invention may be sprayed as an aerosol or non-aerosol upon the surface to be cleaned, or simply poured thereon. Spraying can be accomplished by conventional mechanical spraying devices (such as by use of a conventional trigger spray device) or by using an aerosol dispensing container having a sufficient amount of suitable aerosol propellant. Suitable aerosol propellants are those such as low boiling alkanes or mixtures thereof, such as a mixture isobutane and propane, as is known in the art.

After applying the compositions of the invention to the surface to be cleaned, the compositions may simply be wiped away with the food or other soil by using a nonabrasive, preferably absorbent material, or the surface may be scrubbed with an abrasive or nonabrasive article, such as a lofty, open, three-dimensional nonwoven abrasive article as described by Hoover et. al. in U.S. Pat. No. 2,958,593, incorporated herein by reference, and then wiped dry with a non-abrasive material.

When cleaning fibrous substrates such as carpets, for example those comprising nylon or wool fibers, the compositions may be poured or sprayed on a soiled area as a first step. The composition may then either be rubbed into the soiled area or left to contact the area without rubbing, depending on the substrate, the speed with which the user desires to clean the substrate, and the like. The soil/composition mixture may then be removed from the substrate by soaking in water or by wet vacuuming.

A further understanding of the concentrate and ready-to-use compositions of the invention and their uses in removing food grease, petroleum grease, and "marks" form hard surfaces, and food soils from fibrous substrates will be understood with reference to the following Examples and Test Methods. In the Examples which follow all parts and percentages are by weight unless otherwise specified.

Test Methods

Hard Surface Testing

Ready-to-use compositions within the invention were tested using a series of three tests: food grease removal, petroleum grease removal, and "mark removal."

Test Method 1: Food Grease Removal Test

In the food grease removal tests, a standard food grease solution consisting of equal amounts of soy bean oil and lard dissolved in enough methylene chloride to form a solution was prepared. A small amount of oil blue pigment was added to the solution. 25 millimeter (mm)×75 mm glass slides were then immersed for a few seconds into the food grease and drawn up quickly so that the food grease coated both sides of the slide (25 mm×30 mm on each side). The food grease-coated slides were then dried or "cured" by hanging at room temperature (about 20° C.) for 24 hours.

In the food grease removal test, 140 milliliters (ml) of composition to be tested were placed into a 150 ml glass beaker equipped with a magnetic stir bar (2.5 cm in length). The beaker was then placed on a magnetic stirrer (Barnant Co. model no. 700–5011). The coated glass slide to be cleaned was then suspended vertically in the composition to be tested, coated portion pointing toward the bottom of the beaker with the other end attached to a suitable support, so that the glass slide did not touch anything but the composition being tested, and the stir bar did not hit the glass slide or the sides of the beaker. The magnetic stirrer was immediately turned on and the stirring speed adjusted with a strobe light to 2000 rpm, after which the percent removal of food grease versus time was measured visually for each side of the slide. Slides were not reused.

Test Method 2: Petroleum Grease Removal Test

This test was similar to the food grease removal test. A standard petroleum grease was prepared (at least 2–7 days prior to testing) consisting of 25 grams 20 weight oil, 25 grams industrial lithium grease known under the trade designation "STA-Grease" from Conoco Oil Company, 75 grams heptane, 75 grams methylene chloride and 0.2 gram oil soluble dye. These ingredients were mixed in a beaker equipped with a stir bar and placed on a heater/magnetic stirrer and the grease heated to about 30° C. while keeping a watch glass over the beaker. After the composition reached about 30° C. the beaker was removed from the heater/magnetic stirrer and allowed to cool to room temperature with continued stirring with a glass rod. 25 mm×75 mm glass slides were then immersed for a few seconds into the petroleum grease and drawn up quickly so that the grease coated both sides of the slide (25 mm×30 mm on each side). The food grease-coated slides were then dried by hanging at room temperature (about 20° C.) for 24 hours.

In the petroleum grease removal test, 140 ml of composition to be tested was placed into a 150 ml glass beaker equipped with a magnetic stir bar (2.5 cm in length). The beaker was then placed on a magnetic stirrer (Barnant Co. model no. 700–5011) and the power setting adjusted until the bar rotated at 2000 rpm, using a strobe light to adjust the speed of rotation. The coated glass slide to be cleaned was then suspended vertically in the composition to be tested, coated portion pointing toward the bottom of the beaker with the other end attached to a suitable support, so that the glass slide did not touch anything but the composition being tested, and the stir bar did not hit the glass slide or the sides of the beaker. The percent removal of the petroleum grease was measured visually versus time for each slide and composition tested. Slides were not reused.

Reproducibility for the grease removal Test Methods 1 and 2 is about +/–5%.

Test Method 3: Mark Removal Tests

In the mark removal tests, enamel-coated steel panels were prepared. Four different marks were attempted to be removed from the enamel-coated steel panels: #2 pencil; blue ball-point pen (from a pen known under the trade designation "Papermate"); permanent blue marker known under the trade designation "Sharpie"; and a black china marker known under the trade designation "Berol" #373. Four longitudinal marks (lines) were made on each panel, each line drawn by one of the four markers so that each type of marker was represented. The marked panels were then allowed to stand overnight. It was then attempted to remove the marks with a Gardner abrasion tester, available from Pacific Scientific Co. This machine essentially comprised a horizontal surface to which the marked enamel-coated panels were attached, and a reciprocating holder for a nonwoven surface treating article. A white nonwoven pad (trade designation "Scotch-Brite", #9030, from 3M) was attached to the reciprocating holder so that the pad rubbed across the marked enamel-coated panel. The weight of the holder was approximately 500 grams. The machine was run for 500 cycles thus causing abrasion of the surface of each marked enamel-coated panel. The percent removal of each mark versus number of cycles was recorded at regular intervals up to 500 cycles, or until 100 percent removal. The marked panels were not reused.

Test Method 4: Streaking on Glass

This test attempted to measure the non-streaking ability of the cleaning compositions within the invention.

In each streak test, 30.5 centimeter (cm)×10.2 cm mirrored tiles were first cleaned using isopropanol and a piece of cheesecloth. The tiles were then rinsed with deionized water and dried with another piece of cheesecloth so that the mirrored tiles were streak-free. Two parallel sections of each mirrored tile were then taped off.

To run a test, a different cleaner composition was used on each side of individual tiles, and one side was compared with its matching side, rather than comparing to other tiles. This was because it was found that each of the tiles streaked slightly differently using identical cleaning compositions.

Tiles were then placed in the horizontal holder of a Gardner abrasion tester available from Pacific Scientific. A white nonwoven pad known under the trade designation "Scotch-Brite" #9030 which was 8.9 cm×3.6 cm×2 cm) was wrapped in cheesecloth and then placed in a Petri dish which held the composition to be tested. The wrapped pad was held in the Petri dish for one minute, after which the excess liquid was wiped off of the wrapped pad and the wrapped pad placed in the upper holder of the Gardner tester, solution side down, i.e., facing the mirrored tile. The Gardner tester was run for 10 cycles, then the wrapped pad was turned over so that the dry "side" faced the tile and then 10 more cycles run. This procedure was repeated with another cleaning composition on the second side of the tile.

To determine which side was better (less streaked), two or three persons were chosen to view the tiles to determine which side of the tile looked less streaked. Tests were run in duplicate, i.e., the same two compositions were tested on a second tile. As these were subjective, relative tests, each cleaning composition was compared with another composition on the same mirrored tile. For example, if four cleaning compositions were tested, six tiles were required.

Carpet Cleaning Tests

Compositions within the invention were used to remove food soils from 100% nylon and 100% wool fiber carpets. In the tests, the five food substances used were steak sauce ("Heinz"), tomato juice, mustard, cherry juice, and grape juice. Food soils were made on the carpet samples and left to sit at room temperature (25° C.) for 24 hours. The carpet samples had no carpet protection chemical applied thereto (such as that known under the trade designation "Scotchgard") prior to staining. The removal method was to apply the composition to be tested to the food soil, and immediately after application the composition was manually worked into the food soil with fingers. Then the food soil/composition mixture was vacuumed from the carpet using a wet vacuum. The same wet vacuum was used in each test.

Materials Description

The following materials were used in the Examples which follow: "AO-14-2" is the trade designation for an amine oxide surfactant available from Exxon Chemical Company, Houston, Tex., and is a 50 weight percent dihydroxyethyl isodecyloxypropyl amine oxide, 20 weight percent isopropyl alcohol, and 30 weight percent deionized water;

"Q-17-12" is the trade designation for a quaternary amine salt surfactant available from Exxon Chemical Company, Houston, Tex., and is a 75 weight percent isotridecyloxypropyl dihydroxyethyl methyl ammonium chloride, 25 weight percent propylene glycol;

"ARCOSOLV PTB" is the trade designation for propylene glycol mono-t-butyl ether, available from Arco Chemical Company, Philadelphia, Pa.;

"ARCOSOLV DPM" is the trade designation for dipropylene glycol methyl ether, available from Arco Chemical Company, Philadelphia, Pa.;

"ARCOSOLV PM" is the trade designation for propylene glycol methyl ether, available from Arco Chemical Company, Philadelphia, Pa.;

"EKTASOLVE EEH" is the trade designation for ethylene glycol 2-ethylhexyl ether, available from Eastman Chemical Products, Inc., Kingsport, Ten.;

"EXXAL 8" is the trade designation for a mixture of dimethyl-1-hexanol and methyl-1-heptanol, available from Exxon Chemical Company, Houston, Tex.;

"WITCOLATE 1298" is the trade designation for dodecylbenzenesulfonic acid, from Witco Chemical Company;

"DEQUEST 2010" is the trade designation for the chelating agent 1-hydroxyethylidene-1, 1diphosphonic acid, from Monsanto, St. Louis, Mo.;

"NINOX M" is the trade designation for myristyl amine oxide, formerly available from Stepan, Northfield, Ill.;

"STEOL CS-330" is the trade designation for sodium lauryl ether sulfate, available from Stepan, Northfield, Ill.;

"VARONIC K-205" is the trade designation for cocoamine ethoxylate, available from Sherex Chemical Company, Dublin, Ohio;

"CINCH" is the trade designation for a commercially available hard surface cleaner, available from the Procter & Gamble Company, Cincinnati, Ohio;

"BUTYL-DIPROPASOL" is the trade designation for dipropylene glycol n-butyl ether, available from Union Carbide Corporation, New York, N.Y.;

"CADG-HS" is the trade designation for a cocoamidobetaine amphoteric surfactant, available from Sherex Chemical Company, Dublin, Ohio;

"BHT" is a designation for butylated hydroxytoluene; "A61088" is a trade designation for a citrus fragrance from Haarman & Reimer Company, Rosemount, Ill.;

"MEA" is monoethanolamine, available from Union Carbide Corporation, New York, N.Y.;

"MMB" is a trade designation for 3-methyl-3-methoxybutanol, from Kurary Chemical, Tokyo, Japan;

"ATS" is ammonium thiosulfate, available from Kerley, Inc. Phoenix, Ariz.;

"D&C Red #33" is a red dye available from Pylam company, Garden City, N.Y.; and

"IFI #269" is a fragrance available from Intercontinental Fragrance, Inc., Houston, Tex.

EXAMPLES

Examples 1–3: Concentrates Including Amine Oxides

Three concentrates were prepared from which ready-to-use compositions were subsequently prepared for testing. The compositions of concentrates of Examples 1–3 are presented in Table 2.

TABLE 2

| Component | Ex. 1 (%) | Ex. 2 (%) | Ex. 3 (%) |
|---|---|---|---|
| AO-14-2 | 10.0 | 10.0 | 10.0 |
| ARCOSOLV PTB | — | — | 40.3 |
| ARCOSOLV DPM | — | — | 15.0 |
| ARCOSOLV PM | 51.3 | 12.8 | — |
| MMB | — | 38.0 | — |
| EKTASOLVE EEH | 1.5 | — | 1.5 |
| EXXAL 8 | — | 1.5 | — |
| MEA | 15.0 | 15.0 | 15.0 |
| ATS | ~0.1 | — | — |
| WITCOLATE 1298 | 1.5 | 1.5 | 1.5 |
| DEQUEST 2010 | 0.2 | 0.2 | 0.2 |
| BHT | 0.005 | 0.005 | — |
| D&C Red #33 | 0.008 | 0.010 | — |
| IFI #269 | — | 1.0 | — |
| A61088 | 0.500 | — | — |
| Fragrance | — | — | 1.5 |
| Deionized water | 20.0 | 20.0 | 15.0 |

The concentrates of Examples 1 and 2 were diluted 12:1 with deionized water, while the concentrate of Example 3 was diluted 9:1 with deionized water, to make ready-to-use versions of each.

Examples 4–10

The compositions of Examples 4–10 were variations of the ready-to-use version of the composition of Example 3.

Example 4

Example 4 was the same as the ready-to-use version of Example 3 except that AO-14-12 was replaced with a myristyl amine oxide known under the trade designation "Ninox M".

Example 5

The composition of Example 5 was identical with the ready-to-use version of Example 3 except that ethylene glycol mono-n-hexylether (water solubility of about 1.0 weight percent) was used in place of Ektasolve EEH.

Example 6

The composition of Example 6 was identical to that of the ready-to-use version of Example 3 except that isooctyl alcohol known under the trade designation "Exxal 8" was used in place of Ektasolve EEH. The isooctyl alcohol used had a water solubility of 0.06 weight percent.

Example 7

The composition of Example 7 was the same as the composition of Example 3, ready-to-use version, except that n-octyl pyrrolidone, known under the trade designation "Surfadone LP-100" (water solubility of 0.1 weight percent) was used in place of Ektasolve EEH.

Example 8

The composition of Example 8 was identical with the ready-to-use version of Example 3 except that 1-octanol (water solubility of 0.1 weight percent) was used in place of Ektasolve EEH.

Example 9

The composition of Example 9 was identical with the ready-to-use composition of Example 3 except that 2-ethylhexanol (water solubility of 0.1 weight percent) was used in place of Ektasolve EEH.

Example 10

The composition of Example 10 was identical with the ready-to-use composition of Example 3 except that laurylamine oxide was used in place of AO-14-2.

Comparative Examples A–I, No Amine Oxide

The following comparative compositions were also prepared to illustrate that the combination of an amine oxide and a very slightly water-soluble solvent in Examples 1–10 proved to be synergistic in removing grease and marks.

Comparative Example A

The composition of comparative Example A was identical with the ready-to-use version of Example 3 except that A0-14-2 was omitted, with deionized water added in its place.

Comparative Example B

The composition of comparative Example B was identical with the ready-to-use version Example 3 except that Ektasolve EEH was omitted, with deionized water added in its place.

Comparative Example C

The composition of comparative Example C was the same as the ready-to-use version of Example 3 except that d-limonene (essentially insoluble in water) was substituted for Ektasolve EEH.

Comparative Example D

The composition of comparative Example D was the same as the ready-to-use version of Example 3 except that the glycol ether known under the trade designation "Dowanol PnB" (water solubility of 5.6 weight percent) was substituted for Ektasolve EEH.

Comparative Example E

The composition of comparative Example E was the same as the ready-to-use version of Example 3 except that the sodium lauryl ether sulfate surfactant known under the trade designation "Stool CS-330" was used in place of AO-14-2.

Comparative Example F

The composition of comparative Example F was the same as the ready-to-use version of Example 3 except that the cocoamine ethoxylate surfactant known under the trade designation "Varonic K-205" was used in place of AO-14-2.

Comparative Example G

The composition of this example was a commercial glass/grease cleaner known under the trade designation "Cinch", available from The Procter & Gamble Company, Cincinnati, Ohio.

Comparative Example H

The composition of this comparative example was the same as the ready-to-use version of Example 3 except that the glycol ether known under the trade designation "Butyl-Dipropasol" (water solubility of 3.0 weight percent), available from Union Carbide Corporation, was used in place of Ektasolve EEH.

Comparative Example I

The composition of comparative Example I was identical with the ready-to-use formulation of Example 3 except that the cocoamidobetaine amphoteric surfactant known under the trade designation Varion "CADG-HS", available from Sherex Chemical Corporation, Dublin, Ohio, was used in place of AO-14-2.

The compositions of Example 3–10 and comparative Examples A–I were subjected to food grease removal and petroleum grease removal tests, and the results are presented in Table 3.

TABLE 3

| Example | % Food Grease removal[1] | % Petroleum grease removal[2] |
|---|---|---|
| 3 | 95 | 50% |
| 4 | 80 | — |
| 5 | 85 | — |
| 6 | 95 | 50% |
| 7 | 90 | — |
| 8 | 100 | — |
| 9 | 100 | 90% |
| 10 | 99 | — |
| A | 10 | — |
| B | 10 | — |
| C | 10 | <5% |
| D | 15 | 10% |
| E | <5 | — |
| F | 10 | — |
| G | 10 | 15% |
| H | 50 | 5% |
| I | — | <5% |

[1]Percent removal in 5 minutes
[2]Percent removal in 15 minutes

The data in Table 3 clearly show that the combination of an amine oxide surfactant with a very slightly water- soluble solvent exhibited a synergistic effect resulting in increased cleaning performance. Streak tests run as above described also indicated that the composition of Example 3 was low streaking. Note that increased cleaning performance can be obtained by increasing the amine oxide or the amount of a very slightly water-soluble solvent, with a subsequent increase in streaking due to the reduced percentage of non-streaking glycol ether solvent in the composition.

The ready-to-use formulations of Example 3 and comparative Examples A, B, and G were also tested for mark removal in accordance with the test described previously. Table 4 presents the mark removal test data.

TABLE 4

| | Mark Removal (Percent/Number of Cycles) | | | |
|---|---|---|---|---|
| Example | China Marker | No. #2 Pencel | Pen | Permanent Marker |
| 3 | 100%/9 | 100%/75 | 98%/500 | 65%/500 |
| A | 100%/80 | 100%/80 | 95%/500 | 50%/500 |
| B | 100%/17 | 100%/125 | 95%/500 | 60%/500 |
| G | 100%/15 | 100%/30 | 40%/500 | 30%/500 |

As can be seen by the mark removal data in Table 4, the ready-to-use composition of Example 3 performed favorably with respect to the Comparative Examples.

Example 11: Use of Quaternary Amine Salt Surfactant

The ready-to-use composition of Example 11 was prepared exactly as the ready-to-use composition of Example 1, except that an equal active amount of the quaternary amine salt surfactant "Q-17-12" was used in place of the amine oxide surfactant known under the trade designation "AO-14-2". In the food grease removal test, 75 weight percent of the food grease was removed after 2 minutes, and 95 weight percent after 3 minutes.

Examples 12–21 and Carpet Comparative Examples A–T

The ready-to-use composition of Example 1 was used in Examples 12–16 to remove five food soils from carpet having only 100% nylon fibers, and in Examples 17–21 from carpet having only 100% wool fibers, using the test described above.

Two commercially available compositions were used as comparative compositions: Carpet Comparative Examples A–E used the cleaning composition known under the trade designation "3M Brand Liquid Stain Remover" to remove the food soils from 100% nylon carpet, while Carpet Comparative Examples F–J employed the same composition to remove the food soils from 100% wool carpet. Carpet Comparative Examples K–O employed the cleaning composition known under the trade designation "Compublend Spot N Stain Remover" to remove the five food soils from 100% nylon carpet, while Carpet Comparative Examples P–T used the same composition to remove the five food soils from 100% wool carpet.

In all of Examples 12–21 and all Carpet Comparative Examples A–T, the cleaning composition known under the trade designation "3M Brand Liquid Stain Remover" was slightly superior. The compositions of Examples 12–21 and the cleaning composition known under the trade designation "Compublend Spot N Stain Remover" were substantially equal in performance. There were no deleterious effects on any carpet from any of the cleaning compositions tested, and there was no dye bleeding, fading, or color change observed.

All stains except the cherry juice were completely removed by all three compositions.

Various modifications of the invention will be apparent to those skilled in the art. The examples herein are merely to be taken as describing and illustrating the invention and are in no way intended to limit the scope of the appended claims.

What is claimed is:

1. An aqueous, substantially non-streaking multi-surface cleaning composition, consisting essentially of:

(a) a surfactant system consisting of amine oxides within the general formula (I)

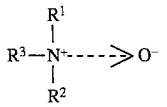

I or quaternary amine salts within the general formula (II)

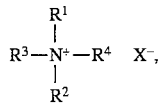

II or combinations of the foregoing amine oxides and quaternary amine salts;

(b) a very slightly water-soluble polar organic compound having a water solubility ranging from about 0.1 to 1.0 weight percent, the very slightly water-soluble polar organic compound present at a weight ratio of said compound to the surfactant system ranging from about 0.1:1 to about 1:1; and (c) water soluble organic compound in an amount effective to reduce streaking, said water soluble organic compound selected from water soluble glycol ethers and water soluble alkyl alcohols, said water soluble organic compound having a water solubility of at least 14.5 weight percent, the weight ratio of said surfactant system to said water soluble organic compound ranging from about 0,033:1 to about 0.2:1; wherein $R^1$ and $R^2$ are the same or different and are selected from the group consisting of methyl, ethyl, propyl, isopropyl, hydroxyethyl and hydroxypropyl, $R^3$ is selected from the group consisting of straight chain alkyls, branched chain alkyls, straight chain heretroalkyls, branched chain heteroalkyls and alkyl ethers, each having from about 10 to 20 carbon atoms, $R^4$ is selected from the group consisting of alkyl groups having from I to about 5 carbon atoms, and X is a halogen atom.

2. Composition in accordance with claim 1 wherein $R^3$ is an alkyl ether.

3. Composition in accordance with claim 2 wherein $R^3$ is a branched chain alkyl ether.

4. Composition in accordance with claim 3 wherein said amine oxide is dihydroxyethyl isododecyloxypropyl amine oxide.

5. Composition in accordance with claim 1 wherein said very slightly water-soluble polar organic compound is selected from the group consisting of ethylene glycol ethers having from about 6 to about 12 carbon atoms, alkyl alcohols having from about 6 to about 12 carbon atoms, and N-alkyl pyrrolidones where said alkyl group has from about 6 to about 10 carbon atoms.

6. Composition in accordance with claim 5 wherein said very slightly water-soluble polar organic compound is an ethylene glycol ether having from about 6 to about 12 carbon atoms.

7. Composition in accordance with claim 5 wherein said very slightly water-soluble polar organic compound is an alkanol having from about 6 to about 12 carbon atoms.

8. Composition in accordance with claim 5 wherein said very slightly water-soluble polar organic compound is an N-alkyl pyrrolidone, said alkyl group having from about 6 to about 10 carbon atoms.

9. Composition in accordance with claim 1 wherein said water soluble glycol ether is selected from the group consisting of ethylene glycol methyl ether, ethylene glycol ethyl ether, ethylene glycol mono-n-butyl ether, diethylene glycol methyl ether, diethylene glycol ethyl ether, methoxy triglycol, ethoxy triglycol, butoxy triglycol, 1-butoxyethoxy-2-propanol, propylene glycol n-propyl ether, propylene glycol, methyl ether, dipropylene glycol methyl ether, 3-methyl-3-methoxybutanol and propylene glycol mono-t-butyl ether.

10. Composition in accordance with claim 1 wherein the weight ratio of said very slightly water-soluble polar organic compound to said surfactant ranges from about 0.2:1 to about 0.4:1.

11. Composition in accordance with claim 1 wherein the weight ratio of said surfactant to said water soluble organic compound ranges from about 0.07:1 to about 0.13:1.

12. An aqueous, multi-surface cleaning composition, consisting essentially of:

(a) a surfactant system consisting of amine oxides within the general formula (I)

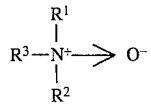

I or quaternary amine salts within the general formula (II)

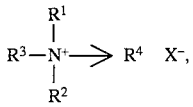

II or combinations of the foregoing amine oxides and quaternary amine salts;

(b) a very slightly water-soluble polar organic compound having a water solubility ranging from about 0.1 to 1.0 weight percent, the very slightly water-soluble polar organic compound present at a weight ratio of said compound to the surfactant system ranging from about 0.1:1 to about 1:1; wherein $R^1$ and $R^2$ are the same or different and are selected from the group consisting of methyl, ethyl, propyl, isopropyl, hydroxyethyl and hydroxypropyl, $R^3$ is selected from the group consisting of straight chain alkyls, branched chain alkyls, straight chain heretroalkyls, branched chain heteroalkyls and alkyl ethers, each having from about 10 to 20 carbon atoms, $R^4$ is selected from the group consisting of alkyl groups having from 1 to about 5 carbon atoms, and X is a halogen atom.

13. Composition in accordance with claim 12 wherein $R^3$ is an alkyl ether.

14. Composition in accordance with claim 13 wherein $R^3$ a branched chain alkyl ether.

15. Composition in accordance with claim 14 wherein said amine oxide is dihydroxyethyl isododecyloxypropyl amine oxide.

16. Composition in accordance with claim 12 wherein said very slightly water-soluble polar organic compound is selected from the group consisting of ethylene glycol ethers having from about 6 to about 12 carbon atoms, alkyl alcohols having from about 6 to about 12 carbon atoms, and N-alkyl pyrrolidones where said alkyl group has from about 6 to about 10 carbon atoms.

17. Composition in accordance with claim 16 wherein said very slightly water-soluble polar organic compound is an ethylene glycol ether having from about 6 to about 12 carbon atoms.

18. Composition in accordance with claim 16 wherein said very slightly water-soluble polar organic compound is an alkyl alcohol having from about 6 to about 12 carbon atoms.

19. Composition in accordance with claim 16 wherein said very slightly water-soluble polar organic compound is an N-alkyl pyrrolidone, said alkyl group having from about 6 to about 10 carbon atoms.

20. An aqueous, substantially non-streaking multi-surface cleaning composition, consisting essentially of:

(a) a surfactant system consisting of amine oxides within the general formula (I)

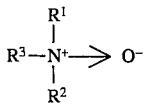

I (b) a very slightly water-soluble polar organic compound having a water solubility ranging from about 0.1 to 1.0 weight percent, the very slightly water-soluble polar organic compound present at a weight ratio of said compound to the surfactant system ranging from about 0.1:1 to about 1:1; and (c) water soluble organic compound in an amount effective to reduce streaking, said water soluble organic compound selected from water soluble glycol ethers and water soluble alkyl alcohols, said water soluble organic compound having a water solubility of at least 14.5 weight percent, the weight ratio of said surfactant system to said water soluble organic compound ranging from about 0.033:1 to about 0.2:1; wherein $R^1$ and $R^2$ are the same or different and are selected from the group consisting of methyl, ethyl, propyl, isopropyl, hydroxyethyl and hydroxypropyl, $R^3$ is selected from the group consisting of straight chain alkyls, branched chain alkyls, straight chain heretroalkyls, branched chain heteroalkyls and alkyl ethers, each having from about 10 to 20 carbon atoms, $R^4$ is selected from the group consisting of alkyl groups having from I to about 5 carbon atoms, and X is a halogen atom.

21. Composition in accordance with claim 20 wherein $R^3$ is an alkyl ether.

22. Composition in accordance with claim 21 wherein $R^3$ is a branched chain alkyl ether.

23. Composition in accordance with claim 22 wherein said amine oxide is dihydroxyethyl isododecyloxypropyl amine oxide.

24. Composition in accordance with claim 20 wherein said very slightly water-soluble polar organic compound is selected from the group consisting of ethylene glycol ethers having from about 6 to about 12 carbon atoms, alkyl alcohols having from about 6 to about 12 carbon atoms, and N-alkyl pyrrolidones where said alkyl group has from about 6 to about 10 carbon atoms.

25. Composition in accordance with claim 24 wherein said very slightly water-soluble polar organic compound is an ethylene glycol ether having from about 6 to about 12 carbon atoms.

26. Composition in accordance with claim 24 wherein said very slightly water-soluble polar organic compound is an alkanol having from about 6 to about 12 carbon atoms.

27. Composition in accordance with claim 24 wherein said very slightly water-soluble polar organic compound is an N-alkyl pyrrolidone, said alkyl group having from about 6 to about 10 carbon atoms.

28. Composition in accordance with claim 20 wherein said water soluble glycol ether is selected from the group consisting of ethylene glycol methyl ether, ethylene glycol ethyl ether, ethylene glycol mono-n-butyl ether, diethylene glycol methyl ether, diethylene glycol ethyl ether, methoxy triglycol, ethoxy triglycol, butoxy triglycol, 1-butoxy-ethoxy-2-propanol, propylene glycol n-propyl ether, propylene glycol methyl ether, dipropylene glycol methyl ether, 3-methyl-3-methoxybutanol and propylene glycol mono-t-butyl ether.

* * * * *